US005354058A

United States Patent [19]

Crecelius

[11] Patent Number: 5,354,058

[45] Date of Patent: Oct. 11, 1994

[54] BOARD GAME

[76] Inventor: David R. Crecelius, 3563 Byers Rd., Delaware, Ohio 43015

[21] Appl. No.: 154,511

[22] Filed: Nov. 19, 1993

[51] Int. Cl.[5] ..... A63D 3/00

[52] U.S. Cl. ..... 273/120 R; 273/118 R

[58] Field of Search ..... 273/118, 119, 120

[56] References Cited

U.S. PATENT DOCUMENTS

| | | | |
|---|---|---|---|
| 2,018,833 | 10/1935 | Cahill . | |
| 2,218,375 | 10/1940 | Axelrod . | |
| 2,463,909 | 3/1949 | Ruch . | |
| 2,753,187 | 7/1956 | Orsini | 273/120 R |
| 3,033,570 | 5/1962 | Mathes et al. | 273/120 R |
| 3,358,997 | 12/1967 | Belz . | |
| 3,460,833 | 8/1969 | Killoren | 273/120 R |
| 3,792,862 | 2/1974 | Livick . | |
| 3,807,738 | 4/1974 | Breslow | 273/120 R X |
| 3,817,529 | 6/1974 | Dobbins . | |
| 3,897,952 | 8/1975 | Breslow | 273/120 R X |
| 4,033,585 | 7/1977 | Foreman . | |
| 4,061,334 | 12/1977 | Kanno | 273/120 A X |

*Primary Examiner*—Vincent Millin
*Assistant Examiner*—Raleigh W. Chiu
*Attorney, Agent, or Firm*—Frank H. Foster

[57] ABSTRACT

A board game comprising a game board having a planar playing surface, a goal at each opposite longitudinal end of the game board, a ramp at each opposite longitudinal end of the game board, a large target ball, a plurality of smaller projectile balls and a railing supported above the playing surface around the outer peripheral edges of a playing field. A network of channels and troughs under the game board channel the balls to desired reservoirs. Projectile balls are rolled down the ramps, onto and across the playing surface with the object of striking the target ball and driving it into the opposing goal.

14 Claims, 4 Drawing Sheets

BOARD GAME

TECHNICAL FIELD

This invention relates to the field of amusement board games, specifically dynamic board games having objects projected onto a playing field for striking a target object and driving the target object into a goal.

BACKGROUND ART

Dynamic amusement board games, those having pieces which are projected across a playing surface, are preferably fun, simple and fast paced. There are many devices for projecting pieces across a playing surface, for example, catapults, spring loaded, pin ball type battering rams, and electric motors inducing vibration of the playing surface. Some board games have simple and more reliable means for projecting the pieces, for example, a surface inclined with respect to the playing surface, down which a ball or disk is rolled onto the playing field.

U.S. Pat. No. 3,792,862 shows a board game having an object which is rolled onto a target at the opposite end of the board. U.S. Pat. No. 3,358,997 shows a board baseball game in which a ball is rolled down a ramp toward the opposite end of the field where the opposing player strikes the ball with a hingedly mounted bat. U.S. Pat. No. 3,817,529 shows a game in which a disk is rolled down an inclined surface to the opposite end of the board onto a target which is part of the board surface. In U.S. Pat. No. 2,463,909, one player of a game tries to knock the opposing player's disks out of the way in the football type board game by rolling his disk down an inclined surface. All of these games have as their object the directing of a ball or disk onto a playing field from a ramp at one end in an attempt to place the rolled object in some desired position on the playing surface.

In U.S. Pat. No. 4,033,585, a ball is rolled from one end of a playing field in an attempt to place the ball through a goal at the opposite end, while players on the sides of the playing field try to intercept the rolling ball with balls of their own. In U.S. Pat. No. 2,018,833, a ball is rolled onto a playing surface in order to strike balls suspended above the playing surface. U.S. Pat. No. 2,218,375 shows a game having ramps at opposite ends of the playing field. In this game, balls having a letter painted on them are rolled down the ramps along a track in a particular order to spell a desired word.

In the above cited patents, the games disclosed appear to be either slow paced compared to the speed of dynamic board games to which people have become accustomed, or else mechanically complex. The need exists, therefore, for a fast paced dynamic board game which is simple in function for reliability and enjoyment.

BRIEF DISCLOSURE OF INVENTION

The invention is a board game comprising a game board having a planar playing surface which has a length, a width and two opposite ends. A pair of goals are positioned with one goal at each of the two opposite ends of the game board. Additionally, there is a pair of centrally facing ramps, one ramp is positioned at each of the two opposite ends of the game board, and each ramp has a surface transverse to the planar playing surface. A lower edge of each ramp surface is positioned near an edge of the planar playing surface. There is a target ball for positioning on the playing surface and having a diameter to permit it to pass through the goals. Furthermore, there is a plurality of projectile balls for rolling down the ramp surfaces and onto the planar surface.

Figure 1:
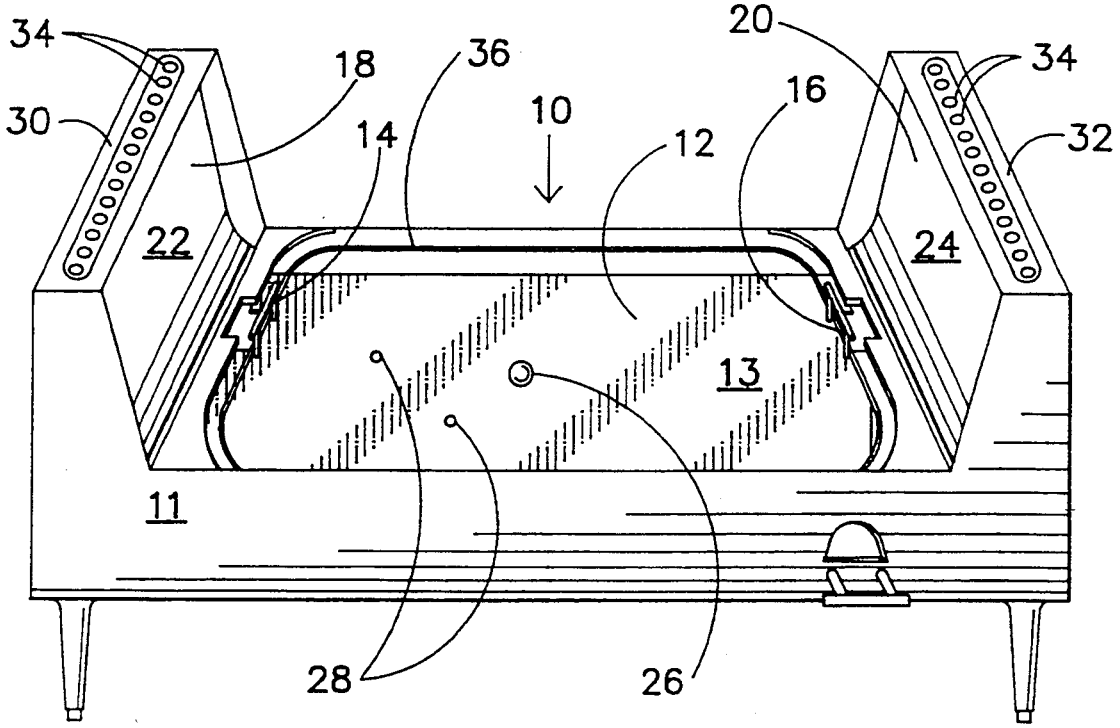
FIG. 1 is a view in perspective illustrating the preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

In FIG. 1, a preferred board game 10 is shown having a planar game board 12 which is approximately three feet long and two feet wide, and which has a planar playing surface 13. Goal posts 14 and 16 are attached to the game board 12 at longitudinally opposite ends. The goal posts 14 and 16 are generally U-shaped and are inverted, with the legs of the "U" extending downwardly into the game board 12. A pair of centrally facing ramps 18 and 20 is attached to a frame 11 of the game 10, one ramp attached to each of two longitudinally opposite ends of the frame 11. The ramp 18 has a ramp surface 22 which is inclined transversely to the planar playing surface 13 of the game board 12. The ramp 20 has a similar ramp surface 24 which is preferably inclined equally transverse to the playing surface 13. The ramp surfaces 22 and 24 preferably have a concave curvature, and also a lower edge (not shown in FIG. 1) which is positioned near an edge of the game board 12, above the playing surface 13.

A lightweight, preferably wooden or plastic target ball 26 is, in use, positioned on the planar playing surface 13 and has a diameter which permits the target ball 26 to pass through the opening in the goal posts 14 and 16. A plurality of heavy, preferably steel projectile balls 28, having a diameter less than the target ball 26 are, in use, rolled down the ramp surfaces 22 and 24 onto the planar playing surface 13.

A first projectile ball guide frame 30 is attached to the frame 11 above the ramp surface 22. A second projectile ball guide frame 32 is attached to the frame 11 above the ramp surface 24 at the opposite end in a similar manner as guide frame 30. Each guide frame 30 and 32 has a plurality of spaced holes 34 formed through it. The holes 34 are preferably cylindrically shaped since the guide frames 30 and 32 have some thickness and the holes 34 are preferably bored through the guide frames 30 and 32. The holes may be lined with tubular sleeves of metal or plastic. The holes could, alternatively, be bored through a guide frame of such insignificant thickness that they are disk shaped. The axis of each spaced hole 34 is preferably parallel to the other holes 34 on the same guide frame and is preferably substantially vertical. The projectile balls 28 have a diameter less than the target ball 26, and the diameter of the projectile balls 28 is slightly less than the diameter of the spaced holes 34, permitting the projectile balls 28 to pass freely through the holes 34, dropping onto the ramp surface 22 or 24.

A railing 36 is supported above the outer peripheral edges of the planar playing surface 13. The railing 36 preferably comprises a pair of stiff, U-shaped metal wires which are, at each of two ends, inserted into holes formed in the sides of goal posts 14 and 16. The lowest edge of the railing 36 is preferably positioned above the planar playing surface a distance greater than the diameter of the projectile balls 28 and less than the diameter of the target ball 26. An inner edge of the railing 36 defines a playing field on the planar playing surface 13, outside of which it is desired that the target ball not pass, except through the opening of the goal posts 14 and 16. Thus, a target ball 26 which reaches the outer limit of the playing field will strike the inner edge of the railing 36 and be deflected away from the outer edge of the playing field defined by the inner edge of the railing 36. A projectile ball 28 which reaches the outer edge of the playing field will pass beneath the railing 36 and exit the playing field uninhibited by the railing 36, since the top of the projectile balls 28 are lower than the bottom edge of the railing 36.

Figure 2:
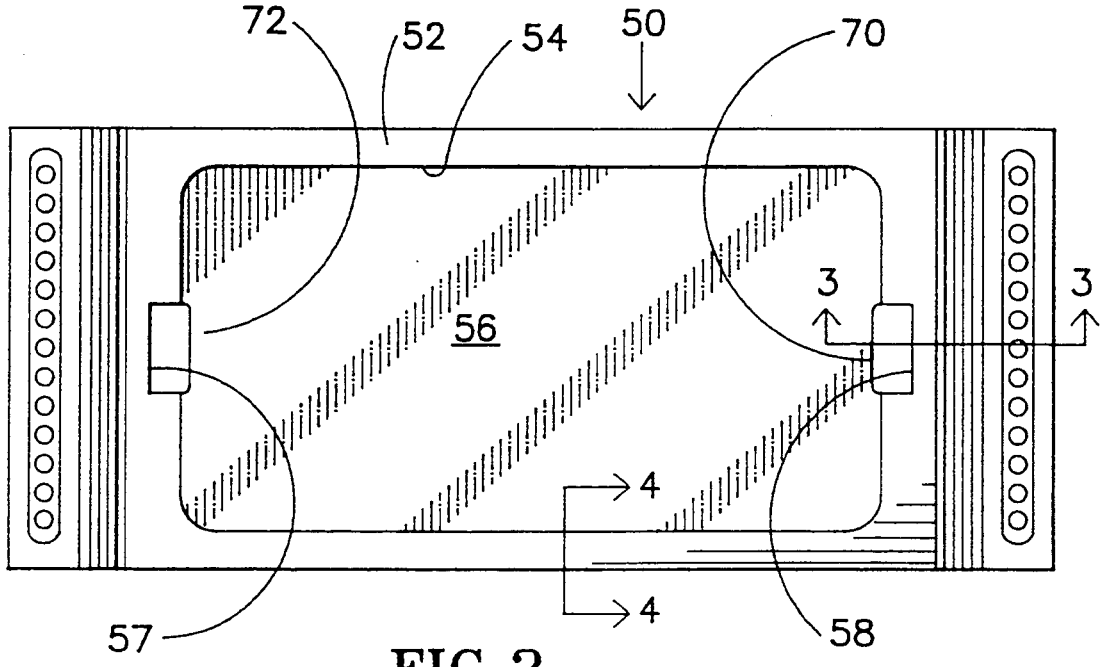
FIG. 2 is a top view illustrating an alternative embodiment of the present invention.

The board game 50 of FIG. 2 is similar to that of FIG. 1, except the game 50 has a different railing 52 to illustrate an alternative device. The railing 52 is a panel with its central portion removed, forming an aperture and an inner edge 54. The inner edge 54 of the railing 52 deflects a target ball back out into the playing field similar to the inner edge of the railing 36 shown in FIG. 1. The inner edge 54 also similarly defines a playing field. One advantage of the railing 52 is that it hides the outer edges of the game board 56 (outside of the playing field) from the player's view. This provides a neat appearance, and hides any projectile balls which go under the railing 52. A rubber or other elastomeric bumper may be attached to the inner edge 54, or to the railing 36 of FIG. 1, to provide a rail cushion. Notches 57 and 58 may be cut out of the railing 52 and notches 70 and 72 are cut out of the game board 56 in order to permit a target ball to pass through each goal, as discussed below. Goal posts may be attached to railing 52 or to the game board 56.

Figure 3:
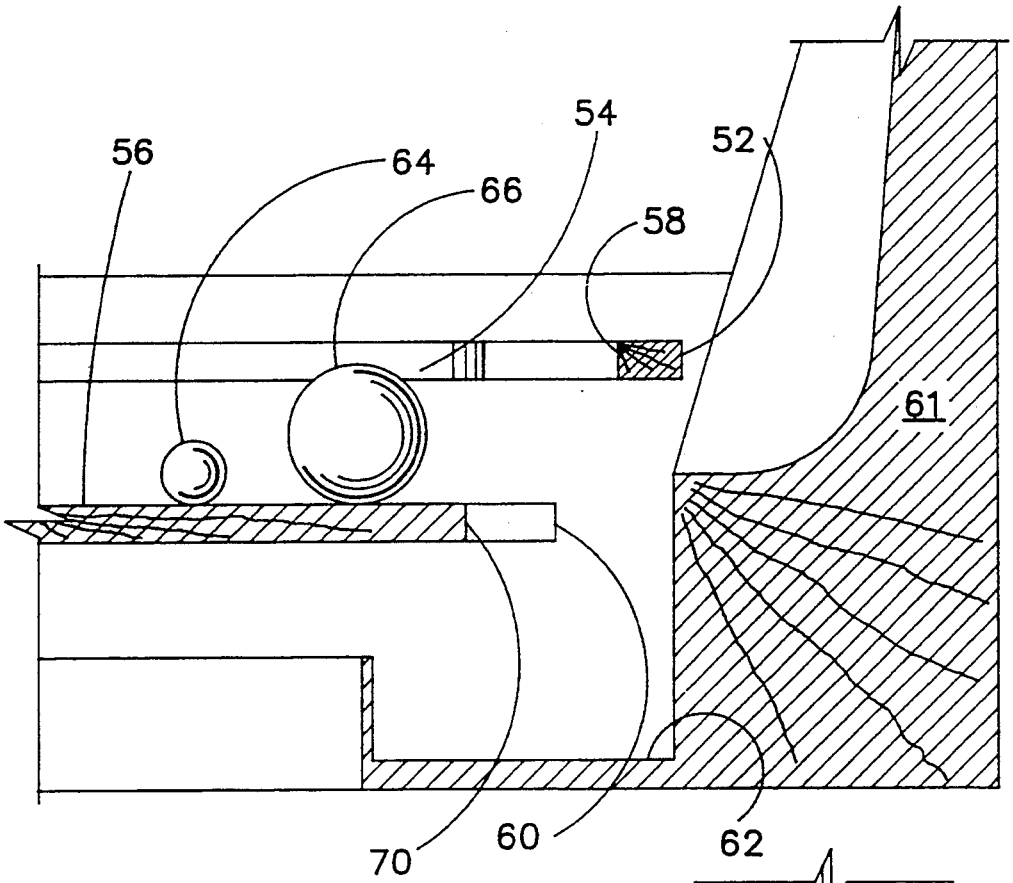
FIG. 3 is a side view in section through line 3—3 of FIG. 2.

FIG. 3 shows the game board 56, a frame 61, and the railing 52 in section. A trough 62 is formed at one longitudinal end of the frame 61 into which a projectile ball 64 or target ball 66 will fall if it passes beyond a ledge 60. The ledge 60 is formed at the terminal peripheral edge of the game board 56, longitudinally outward of the inner edge 54 of the railing 52. The trough 62 and a similar trough (not shown) at the opposite longitudinal end of the game board 56 receive the target ball 66 and many projectile balls 64 which fall over the edge of the game board 56. A target ball 66 contacting the inner edge 54 will not fall down the ledge 60, since it is held away from the ledge 60 by the railing 52. The detailed function of the troughs in the present invention is described below with respect to a different embodiment.

Notches 57 or 58 formed in the railing 52 are each of approximately equal width as notches 70 and 72 in the game board 56, and are cut into the longitudinal ends of the game board 56, extending toward the middle of the game board 56, inwardly beyond the inner edge 54 of the railing 52. The notch 70 and a similar notch 72, shown in FIG. 2 at the opposite longitudinal end of the game board 12, comprise the goals, and permit the larger diameter target ball 66 to pass through the goal and into the trough 62 due to the opening formed by the notches being larger than the diameter of the target ball 66. Alternatively, the notches in the game board 56 can be eliminated by terminating the game board 56 sufficiently close to the inner edge 54 at the ends of the playing field that a ball entering the notch 57 or 58 will fall off the game board 56.

Figure 4:
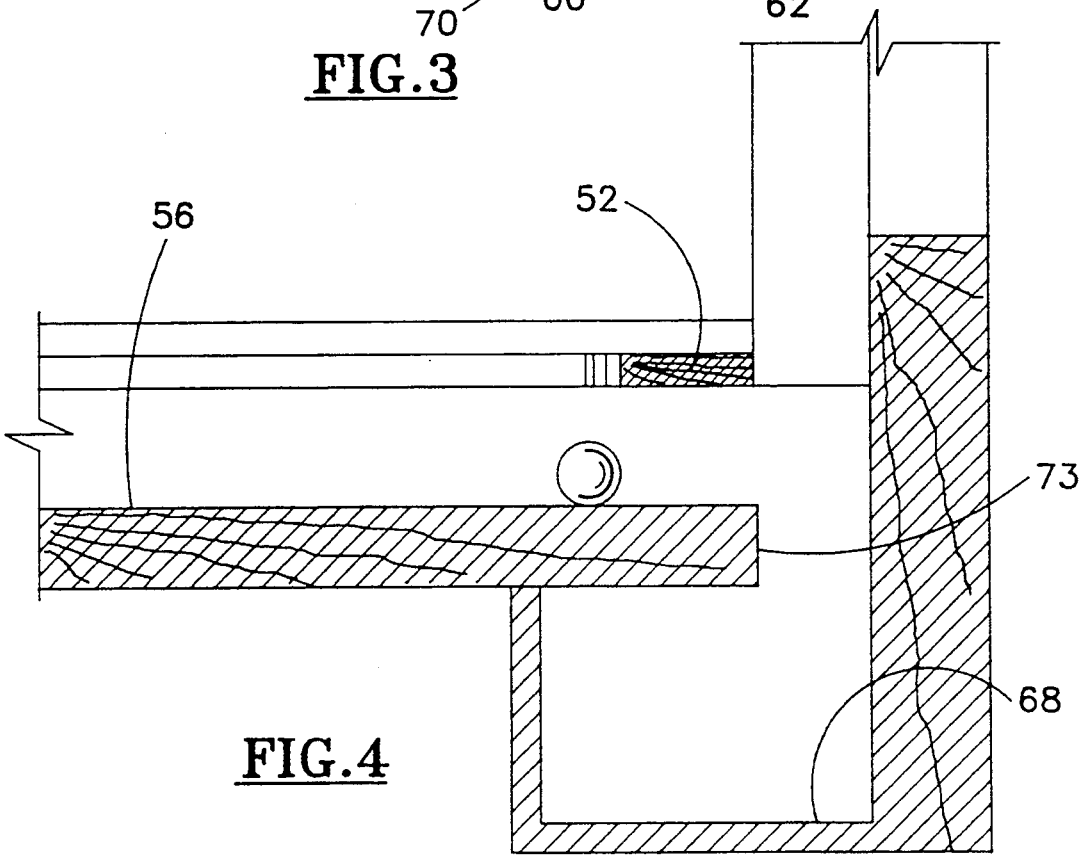
FIG. 4 is an end view in section through line 4—4 of FIG. 2.

Referring to FIG. 4, the game board 56 and railing 52 are shown supported above a side trough 68. The side trough 68 and a similar trough (not shown) positioned at the opposite lateral side of the game board 56 connect with the troughs at the longitudinal ends of the game board 56 discussed in relation to the embodiment of FIG. 3. A projectile ball 64 which passes beneath the railing 52 at the lateral peripheral edge of game board 56 will fall down the ledge 73 and into the trough 68. The lateral side troughs of FIG. 4 are not a part of the preferred embodiment. The preferred embodiment only has troughs at each opposite longitudinal end of the game board.

Figure 5:
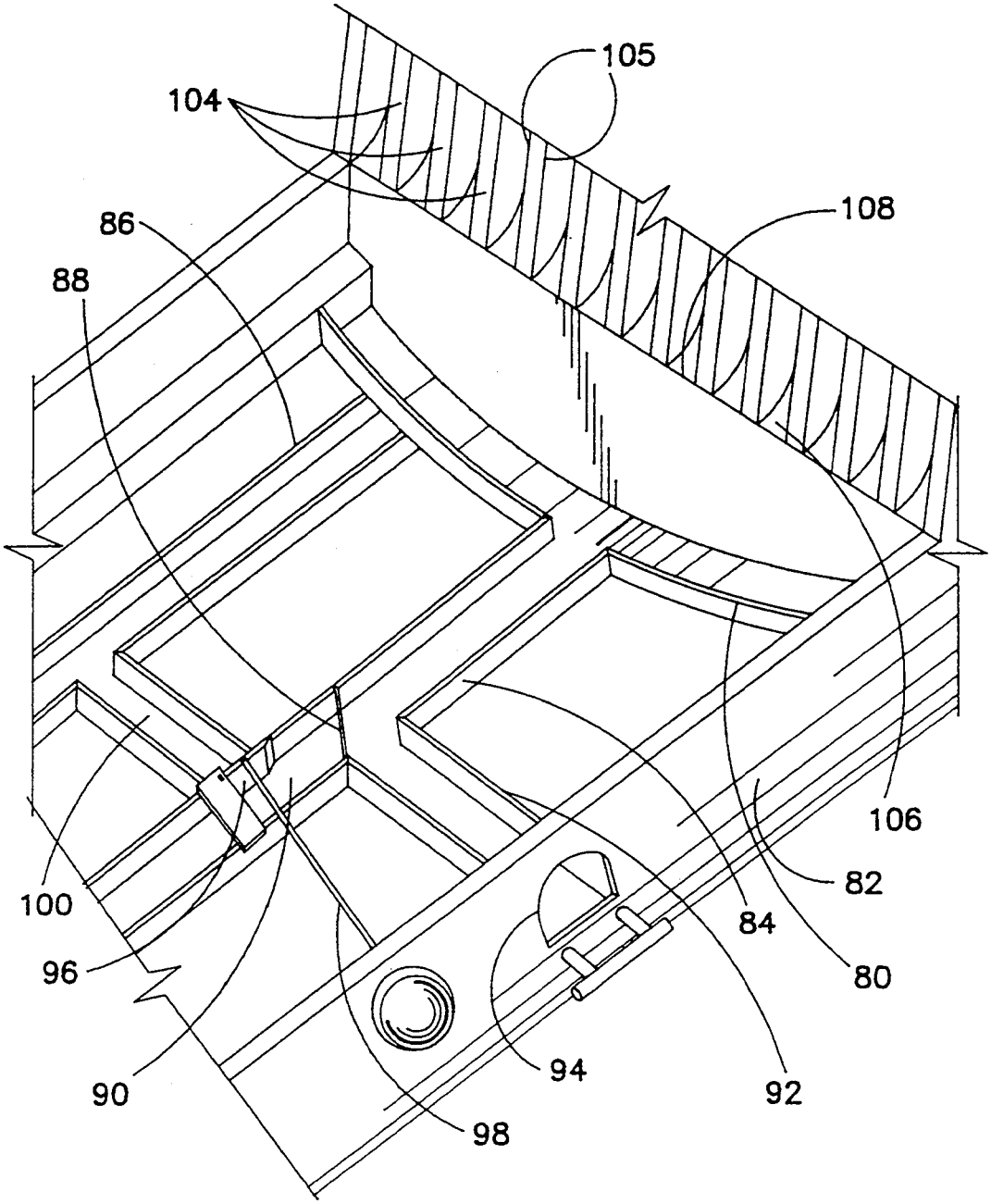
FIG. 5 is a view in perspective illustrating the network of channels and troughs beneath a game board of the present invention.

FIG. 5 shows the preferred network of passageways connected to a trough 80 at one longitudinal end of a game 82. A channel 84 attaches perpendicularly to the trough 80 and extends the length of the game 82, permitting projectile balls which fall into the trough 80 to travel by gravity along a floor 90 of the downwardly inclined channel 84 to the opposite end of the game 82, preferably to a reservoir (not shown) accessible by the sender of the projectile ball. A channel 86 attaches perpendicularly to a trough at the opposite longitudinal end of the game 82 as the trough 80. Any projectile balls which fall into the trough opposite trough 80 travel down the inclined channel 86 to the opposite end of the game 82, preferably to a reservoir (not shown) accessible by the sender.

An angled bar 88 is suspended across the channel 84 above the floor 90 a distance less than the diameter of a target ball. When a target ball falls into the trough 80 it is conveyed by gravity into the channel 84, striking the angled bar 88. The ball is then deflected into channel 92, which is attached to channel 84, and rolls by the force of gravity towards an access hole 94. In summary, when the target ball falls into the trough 80 through the goal, the target ball then travels through the network of channels beneath the game board and exits at the access hole 94. Door 96 and rod 98 are pivotally attached. When the rod 98 is displaced laterally outward, the door 96 pivots across the channel 84, and any projectile balls which fall into the trough 80 travel into a channel 100 then into channel 86. By pulling rod 98, an alternative version of the game is enabled in which balls sent by player A do not return to player A's reservoir, but rather travel (via gravity) to player B's reservoir. A similar network of channels and apparatus is positioned at the opposite longitudinal end of the game 82 as that illustrated in FIG. 5.

The present invention operates in the following manner. Referring to FIG. 1, each of two players at opposite longitudinal ends of the game 10 possess a plurality of projectile balls 28 in reservoirs (not shown). The target ball 26 is placed in the center of the playing field and a signal is given to begin. Each player simultaneously inserts one or more of his projectile balls 28 into the player's choice of one or more of the holes 34. The projectile balls 28 drop through the hole under the influence of gravity onto the ramp surfaces 22 and 24. The projectile balls 28 roll down the ramp surfaces and are projected onto the planar playing surface 13 of the game board 12. The projectile balls 28 roll longitudinally over the planar playing surface 13, desirably striking the target ball 26 and driving it toward and through the opening in the opposing goal post. Most projectile balls 28 continue longitudinally across and off of the playing field even if they strike another projectile ball 28 or the target ball 26.

Referring to FIG. 3, the moving projectile balls 64 reach the edge of the game board 56 and fall over the ledge 60 into the troughs at one of the longitudinal ends of the game board 56. In an alternative embodiment shown in FIG. 4, projectile balls 64 can also fall into additional troughs at the lateral edges of the game board 56. These projectile balls 64 then travel through a network similar to that illustrated in FIG. 5 which returns the projectile balls by gravity to a reservoir accessible either by their sender or the player opposite the sender, holds all projectile balls in one or more reservoirs not accessible by either player, or stores the projectile balls in some other reservoir.

When the target ball passes through the opening in a goal, it enters a trough and is conveyed by gravity along the same network of channels to a reservoir which is accessible by either player, preferably at the end of the game where it entered the goal. The target ball is then placed back onto the surface of the game board and the game is resumed, with the player scoring the goal increasing his score accordingly.

The preferred ramps 18 and 20 shown in FIG. 1 comprise a single, wide, concavely curved sheet which is smooth and hard. An alternative to the single, wide ramp is illustrated in FIG. 5. A plurality of parallel walls 104 attached to each ramp surface 106, extends from the lowest edge 108 of the ramp surface 106 to the highest edge (not shown in FIG. 5). The walls 104 divide the ramp surface 106 into a plurality of narrow ramps, or chutes, defined by the outer edges 105 of each of the walls 104. Projectile balls travel down the ramp surface 106, guided along a specific path by the outer edges 105 of the walls 104. The edges 105 of each chute are aligned with the sidewalls of a corresponding cylindrical hole formed in a projectile ball guide frame, similar to the guide frames 30 and 32 shown in FIG. 1.

It is preferred that the width of the playing field not exceed substantially the lateral width of the ramp surfaces at each opposite end of the playing field. These relative sizes are preferred since this structure will keep the target ball in the paths of the projectile balls, allowing a player to send a projectile ball to contact the target ball at any position on the playing field. If the lateral width of the playing field exceeds the lateral width of the ramp surface by a substantial amount, then a target ball could rest against the inner edge of the railing at one side and a projectile ball could not be rolled onto the playing field along a path which would intercept the target ball.

It is also preferred that the shape of the inner edge of the railing, and therefore the shape of the playing field, is generally rectangular with rounded corners, as illustrated in FIGS. 1 and 2 by the railings 36 and 52, respectively. Because the corners of the playing field are rounded, the target ball is less likely to become trapped in any part of the field. If the corners of the playing field were left as right angles, a target ball resting against the inner edge of the railing near a corner could be struck by a projectile ball travelling along a path perpendicular to the inner edge of the railing and, upon being struck, would be less likely to move. With the present invention, the inner edge of the railing is preferably oriented and constructed so that a projectile ball striking a target ball resting against the inner edge of the railing will keep the target ball in play. It is, of course, possible to make the railing with sides perpendicular to a projectile ball trajectory to provide a variation of the game, however, this is not preferred.

The planar playing surface of the game board is preferably hard and smooth, having the least frictional effect on the target and projectile balls as possible. Some game board materials possessing desirable characteristics include hardboard, plastic sheeting and Formica laminated wood panels. If a slower or quieter game is desired, the planar playing surface of the game board can be covered with a felt, cork, rubber or another softer, higher friction material.

The cylindrical holes which are formed in the projectile ball guide frames 30 and 32 attached above the ramp surfaces 22 and 24 of FIG. 1 preferably eliminate all but the vertical components of motion of the projectile balls 28. Therefore, little or no lateral travel of the projectile balls 28 will occur as they roll down the ramp surfaces 22 and 24. This provides more consistent aiming or prediction of projectile ball trajectory.

The width of the goal is preferably approximately three times as wide as the diameter of the target ball. Although this may be varied, it has been found that this is the preferable width. If chutes are formed by parallel walls extending down the ramp surfaces, as shown in FIG. 5, then there are preferably three chutes positioned between the lateral edges of the goal opening.

Figure 6:
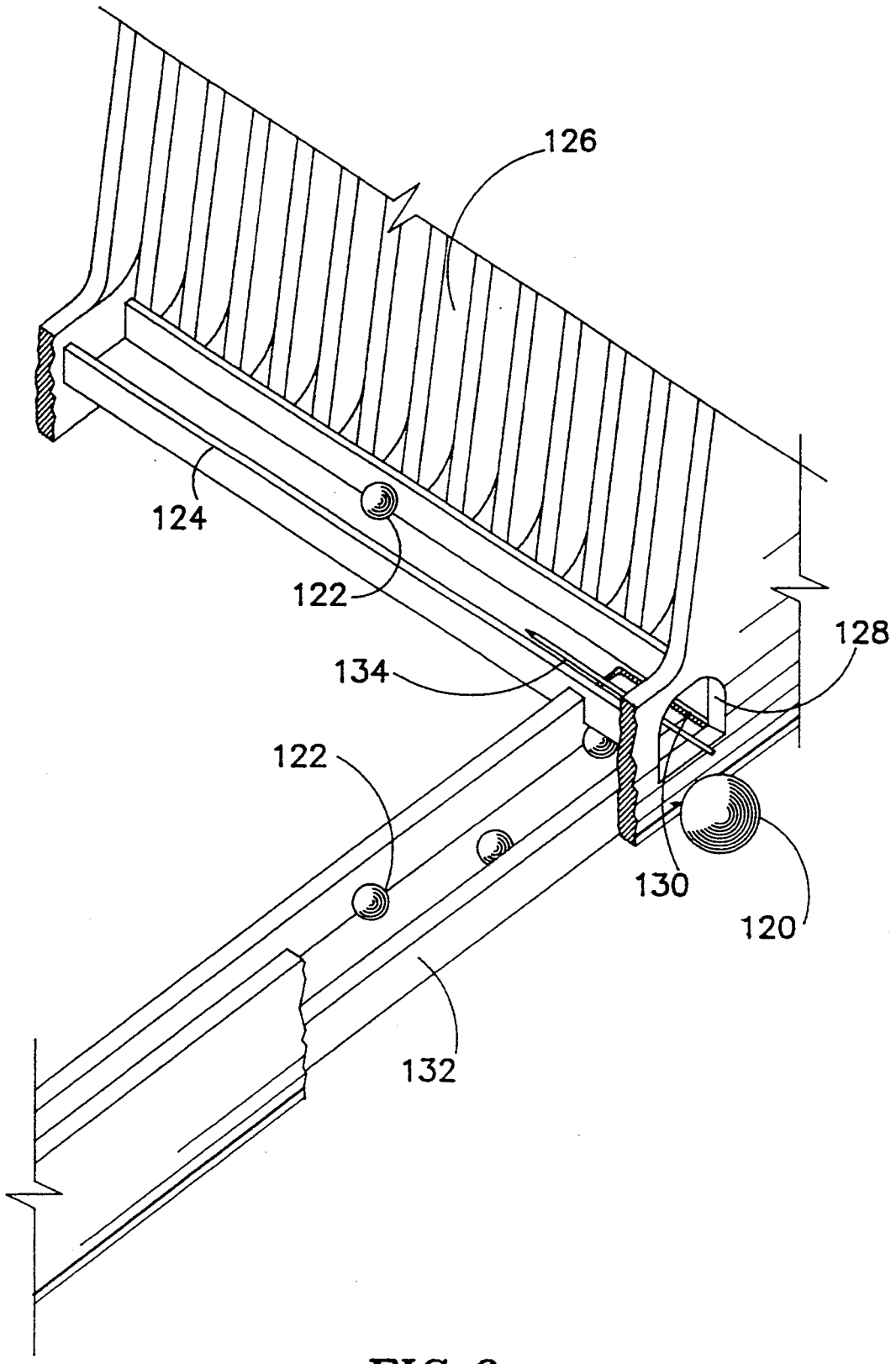
FIG. 6 is a view in perspective illustrating a portion of a simplified, alternative network of channels and troughs beneath the playing field of the present invention.

FIG. 6 shows a portion of an embodiment of the present invention having improved and simplified channels for returning the target ball 120 and projectile balls 122 for further play. The embodiment of FIG. 6 illustrates the use of a pair of linear channels made of PVC, sheet metal or the like, located beneath one end and one side of the game board. An identical pair of linear channels are located at the other end and other side, and are therefore not illustrated. One end channel 124 is positioned below the ramp 126 and is inclined downwardly toward an outlet port 128 to receive projectile balls 122 as they fall from the end of a playing field game board. Near the lower end of the end trough 124 is a bottom hole 130 forming a trap through which the projectile balls 122 may fall into a side trough 132. The side trough 132 is inclined downwardly and extends to the opposite end of the game board to an outlet where they may be retrieved by a player so that projectile balls falling through the trap hole 130 are returned to the player at the opposite end.

The trap hole 130 is more than twice as wide as a projectile ball 122, and has a linear rod 134 fixed above it. The linear rod 134 prevents the target ball 120 from falling through the trap hole 130, and consequently assists in conveying it to the outlet port 128. However, the trap hole 130 is sufficiently wide that a projectile ball may fall to one side or the other of the linear rod 138 and fall through the trap hole 130 into the trap 132.

While certain preferred embodiments of the present invention have been disclosed in detail, it is to be understood that various modifications may be adopted without departing from the spirit of the invention or scope of the following claims.

I claim:

1. A board game comprising:

(a) a game board having a planar playing surface having a length, a width and two opposite ends;

(b) a pair of goals, one goal at each of the two opposite ends of the game board;

(c) a pair of centrally facing ramps, one ramp at each of the two opposite ends of the game board, each ramp having a surface transverse to the planar playing surface, a lower edge of each ramp surface positioned near an edge of the planar playing surface;

(d) a target ball for positioning on the planar playing surface and having a diameter adapted to permit it to pass through the goals;

(e) a plurality of projectile balls for rolling down the ramp surfaces and onto the planar playing surface; and (f) a pair of projectile ball guide frames, attached above a ramp surface, each frame having a plurality of spaced holes formed through it.

2. A board game in accordance with claim 1 wherein the holes in the frame are cylindrically shaped.

3. A board game in accordance with claim 1 wherein the target ball diameter is greater than the diameter of the projectile balls.

4. A board game comprising:

(a) a game board having a planar playing surface having a length, a width and two opposite ends;

(b) a pair of goals, one goal at each of the two opposite ends of the game board;

(c) a pair of centrally facing ramps, one ramp at each of the two opposite ends of the game board, each ramp having a surface transverse to the planar playing surface, a lower edge of each ramp surface positioned near an edge of the planar playing surface;

(d) a target ball for positioning on the planar playing surface an having a diameter adapted to permit it to pass through the goals;

(e) a plurality of projectile balls for rolling down the ramp surfaces and onto the planar playing surface, the target ball diameter being greater than the diameter of the projectile balls; and (f) a railing supported above and surrounding a portion of the planar playing surface, the railing having an inner edge defining a playing field on the planar playing surface and having a lower edge positioned above the planar playing surface a distance greater than the diameter of the projectile balls and less than the diameter of the target ball.

5. A board game in accordance with claim 4 wherein the game further comprises a pair of troughs and a pair of ledges, each ledge formed by a terminal peripheral edge of the game board positioned outwardly of the inner edge of the railing at each opposite end of the planar playing surface, down which the target and projectile balls fall, into a trough, each trough formed at each of the opposite ends, vertically beneath the ledges.

6. A board game in accordance with claim 5 wherein the game further comprises a second pair of ledges, each ledge formed by a terminal peripheral edge of the game board at each of two sides of the planar playing surface, positioned outwardly of the inner edge of the railing and a second pair of troughs, one trough supported beneath each of the ledges of the second pair of ledges.

7. A board game in accordance with claim 6 wherein the game further comprises a network of interconnected passageways formed beneath the planar playing surface which connect to each of the troughs for conveying the projectile balls and the target ball along the troughs and passageways by gravity to at least one accessible reservoir.

8. A game board in accordance with claim 7 wherein the playing field has a width which is not greater than substantially the width of the ramps at each of the two opposite ends of the game board.

9. A game board in accordance with claim 8 wherein the shape of the playing field is rectangular with rounded corners.

10. A game board in accordance with claim 9 wherein the railing comprises a stiff metal wire.

11. A game board in accordance with claim 9 wherein the railing comprises a planar panel spaced above the playing field and having an aperture with inner edges defining the playing field.

12. A game board in accordance with claim 4 wherein each ramp surface has a concave curvature.

13. A game board in accordance with claim 12 wherein the ramps further comprise a plurality of parallel walls attached to each ramp surface, extending from the lowest position to the highest position on each ramp surface, dividing each ramp into a plurality of chutes, defined by the walls, through which the projectile balls travel, and each chute is aligned with a corresponding cylindrical aperture formed through the frame.

14. A game board in accordance with claim 4 wherein the goal further comprises an aperture formed through the planar playing surface having sufficient size to permit passage of the target ball.

* * * * *